US006330407B1

(12) United States Patent
Tsukida et al.

(10) Patent No.: US 6,330,407 B1
(45) Date of Patent: Dec. 11, 2001

(54) IMAGE FORMING APPARATUS WITH CONTROL OF VOLTAGE APPLICATION TO INTERMEDIATE TRANSFER MEMBER

(75) Inventors: Shinichi Tsukida, Yono; Toshiaki Miyashiro, Shizuoka-ken; Kimitaka Ichinose, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/337,127

(22) Filed: Jun. 21, 1999

(30) Foreign Application Priority Data

Jun. 19, 1999 (JP) ..... 10-172931

(51) Int. Cl.[7] ..... G03G 15/16; G03G 15/01
(52) U.S. Cl. ..... 399/66; 399/302
(58) Field of Search ..... 399/298, 302, 399/308, 66

(56) References Cited

U.S. PATENT DOCUMENTS 5,264,902 * 11/1993 Suwa et al. ..... 355/282
5,287,163 * 2/1994 Miyashiro et al. ..... 355/326
5,523,829 * 6/1996 Miyashiro et al. ..... 355/271
5,640,645 * 6/1997 Namekata et al. ..... 399/302 X
5,761,594 * 6/1998 Seto et al. ..... 399/302
5,809,373 * 9/1998 Yoda et al. ..... 399/101
5,887,218 * 3/1999 Yuu et al. ..... 399/302 X
5,890,030 * 3/1999 Namekata et al. ..... 399/302 X
5,899,610 * 5/1999 Enomoto et al. ..... 399/302

FOREIGN PATENT DOCUMENTS 7-225520 * 8/1995 (JP) .

* cited by examiner

*Primary Examiner*—Fred L Braun
(74) *Attorney, Agent, or Firm*—Fitzpatrick, Cella, Harper & Scinto

(57) ABSTRACT

An image forming apparatus has an image bearing member for bearing a different color toner image; a movable intermediate transfer member; voltage applicator for applying a voltage to the intermediary transfer member to effect electrostatic, sequential and superimposing transfer of the different color toner images from the image bearing member onto the intermediary transfer member at a transfer position A first toner image on the intermediary transfer member passes through the transfer position in the period which is after a first toner image is transferred from the image bearing member onto the intermediary transfer member by the voltage applicator and which is before a second toner image which is immediately subsequent to the first toner image is transferred from the image bearing member onto the intermediary transfer member; and a control for switching a voltage applied to the intermediary transfer member from a first voltage for transferring the first toner image from the image bearing member onto the intermediary transfer member to a second voltage having an absolute value larger than that of the first voltage, before a leading edge of the first toner image on the intermediary transfer member reaches the transfer position during the period.

59 Claims, 8 Drawing Sheets

$$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

IMAGE FORMING APPARATUS WITH CONTROL OF VOLTAGE APPLICATION TO INTERMEDIATE TRANSFER MEMBER

FIELD OF THE INVENTION AND RELATED ART

The present invention relates to an image forming apparatus employing an electrophotographic system, an electrostatic recording system, or the like. In particular, it relates to an image forming apparatus comprising an intermediary transfer member, in addition to those systems mentioned above.

As an image forming apparatus capable of forming an image with no color aberration, an image forming apparatus with an intermediary transfer member has been proposed. FIG. 12 illustrates the general structure of such an image forming apparatus. A photosensitive drum 101 which is being driven in the direction indicated by an arrow mark is first uniformly charged on its peripheral surface by a charge roller 102. Next, the charged surface is exposed to a laser beam 103, which is moved in a manner to scan the peripheral surface of the photosensitive drum 101 while being turned on or off on the basis of image formation data. As a result an electrostatic latent image is formed on the photosensitive drum 101. This electrostatic latent image is developed (visualized) by a developing apparatus 104 in which a plurality of developing devices 104*a,* 104*b,* 104*c,* and 104*d* are rotatively disposed so that their position can be switched. Each of these developing devices comprises a development sleeve. Black toner as the toner of the first color is contained in the first development device 104*a;* magenta color toner as the toner of the second color, in the second developing device 104*b;* cyan color toner as the toner of the third color, in the third developing device 104*c,* and yellow color toner as the toner of the fourth color is contained in the fourth developing device 104*d.* The aforementioned electrostatic latent image is developed (visualized) by the first developing device 104*a* containing black toner as the first toner. The normal polarity of the toner is negative. The first toner image, that is, the image created by developing the electrostatic latent image with the use of the first toner, is electrostatically transferred (primary transfer), at the first transfer point 106*a,* onto the surface of an intermediary transfer belt 105 which is being rotatively driven in the direction indicated by an arrow mark, with the surface of the intermediary transfer belt 105 squarely facing the peripheral surface of the photosensitive drum 101. After the primary transfer, a small amount of the first transfer residual toner, that is, the toner remaining on the peripheral surface of the photosensitive drum 101 after the first transfer, is removed by a cleaning apparatus 107.

Next, the above described process is repeated three more times. As a result, toner images are transferred in layers onto the surface of the intermediary transfer belt 105. More specifically, the second toner image created by developing an electrostatic image by the magenta toner, the third toner image created by developing an electrostatic latent image by the cyan toner, the fourth toner image created by developing an electrostatic latent image by the yellow toner, are consecutively transferred in layers onto the surface of the intermediary transfer belt 105.

Thereafter, a transfer roller 108 for the secondary transfer, which is kept separated from the surface of the intermediary transfer belt 105 when not in action, is placed in contact with the surface of the intermediary transfer belt 105, and is rotatively driven. The interface between the photosensitive drum 101 and the transfer roller 108 for the secondary transfer forms a secondary transfer point (station) 106*b,* at which the toner images on the surface of the intermediary transfer belt 105 are transferred (secondary transfer) all at once onto the surface of a piece of transfer medium P conveyed to the second transfer point 106*b* with predetermined timing. This transfer medium P is conveyed to an unillustrated fixing apparatus, in which the full-color image composed of four color toner images is fixed. Thereafter, the recording medium is discharged out of the image forming apparatus.

In the case of an image forming apparatus in which the places of a plurality of the aforementioned developing devices must be switched by the rotary moving means 4 for each development step, the provision of the time t for switching the developing device is necessary for each color, and this time t affects the size of the intermediary transfer belt 5 in the following manner.

That is, the intermediary transfer belt is being rotatively driven at a predetermined velocity even during the developing device switching time t, and therefore, the peripheral length L of the intermediary transfer belt must include the margin V−t for switching the developing devices. Thus, when the length of the largest piece of recording medium usable with the image forming apparatus is $L_p$, the following relationship must be satisfied.

$$L-L_p \geqq V-t \tag{1}$$

Provided, for example, that the developing device switching time t is 1,200 milliseconds, and recording medium size is A4 (210 mm in width×297 mm in length)/letter size 215.9 mm in width×279.4 in length), in order to print a full-color image at a processing speed V, the intermediary transfer belt must be longer in peripheral length than 441 (mm)=297 (mm)+1,200 (msec)×120 (mm/sec). However, the condition expressed by the formula (1) is such a condition that is required only for forming a full-color image by placing in layers a plurality of toner images. In other words, when a monochrome image is formed, the aforementioned relation does not need to be satisfied because the formation of a monochrome image does not require the developing device switching time t. Therefore, the size of a monochrome image can be as large as the peripheral length of the intermediary transfer belt 5 can afford. For example, in the case of an image forming apparatus capable of forming an image which is 215.9 mm long in terms of the rotational direction of the intermediary transfer belt, that is, accommodating a piece of recording medium as long as 215.9 mm, it can form a monochromatic image as large as the printable surface size of a legal size recording medium (215.9 mm in width×355.6 in length), that is, the longest sheet of recording medium among the cut sheets of known regulation sizes, but cannot form a full-color image as large as a legal size monochrome image, which makes the apparatus odd in terms of specification, and confuses the user. Further, if an attempt is made to solve this problem by employing an intermediary transfer belt which makes it possible to form a full-color image matching the legal size, the image formation apparatus size becomes rather large, which inevitably leads to cost increase.

Japanese Laid-Open Patent Application No. 225,520/1995 discloses an image forming process, according to which, when it is necessary to form a full-color image on a large piece of recording medium, the intermediary transfer belt is idled one full rotation, instead of transferring (primary transfer) the toner image of the second toner onto the recording medium immediately after the toner image of the first color is transferred (primary transfer) onto the surface of the intermediary transfer belt, so that during this idling period, the developing device for the first color is switched with the developing device for the second color. Then, the toner image of the second color is transferred onto the surface of the intermediary transfer belt. In other words, the intermediary transfer belt is rotated seven times overall to finish transferring a full-color image onto the recording medium. Further, in order to prevent the so-called reverse transfer phenomenon, that is, a problematic phenomenon that the toner which has been transferred (primary transfer) onto the surface of an intermediary transfer belt is transferred back onto the peripheral surface of a photosensitive drum, the amount of the power given to the cornea type charging device for primary transfer during the non-transfer period in which the intermediary transfer belt is idled is reduced.

However, an image forming apparatus with the structure described above suffered from the problems described below.

These problems became more noticeable when single component magnetic black toner was used as the toner of the first color, along with the toners of the other colors: magenta toner as the toner of the second color; cyan toner as the toner of the third color; and yellow toner as the toner of the fourth color. The employment of single component magnetic black toner as the black toner for a full-color image forming apparatus meant that the so-called pulverization toner, which had been used in conventional monochromatic image forming apparatuses, was usable without modification, which was quite beneficial in terms of cost reduction. However, the electrostatic capacity of single component magnetic toner in a developing apparatus was approximately −30–−50 ($\mu$C/g), which was relatively small, whereas the electrostatic capacity of nonmagnetic single component toner in a developing apparatus was approximately −30–−50 ($\mu$C/g), which was relatively high. In other words, the adhesion of magnetic single component toner to the surface of an intermediary transfer belt was relatively weak. Thus, when magnetic single component toner was used along with an image forming apparatus in which the control disclosed in the aforementioned Japanese Laid-Open Patent Application No. 225,520/1995 is carried out while forming an image on a sheet of recording medium as large as the aforementioned large sheet of recording medium, the reversal transfer phenomenon, that is, the phenomenon that toner having been transferred onto the surface of an intermediary transfer belt from a photosensitive drum was transferred back onto the photosensitive drum, occurred with very noticeable results. This phenomenon was more likely to occur under such a condition as a high temperature-high humidity condition, in which it was difficult to keep electrical charge stable, and the occurrence of this phenomenon resulted in an image which appeared faint in some areas.

SUMMARY OF THE INVENTION

The primary object of the present invention is to make it possible to form high quality images without increasing the size of an image forming apparatus.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Figure 1:
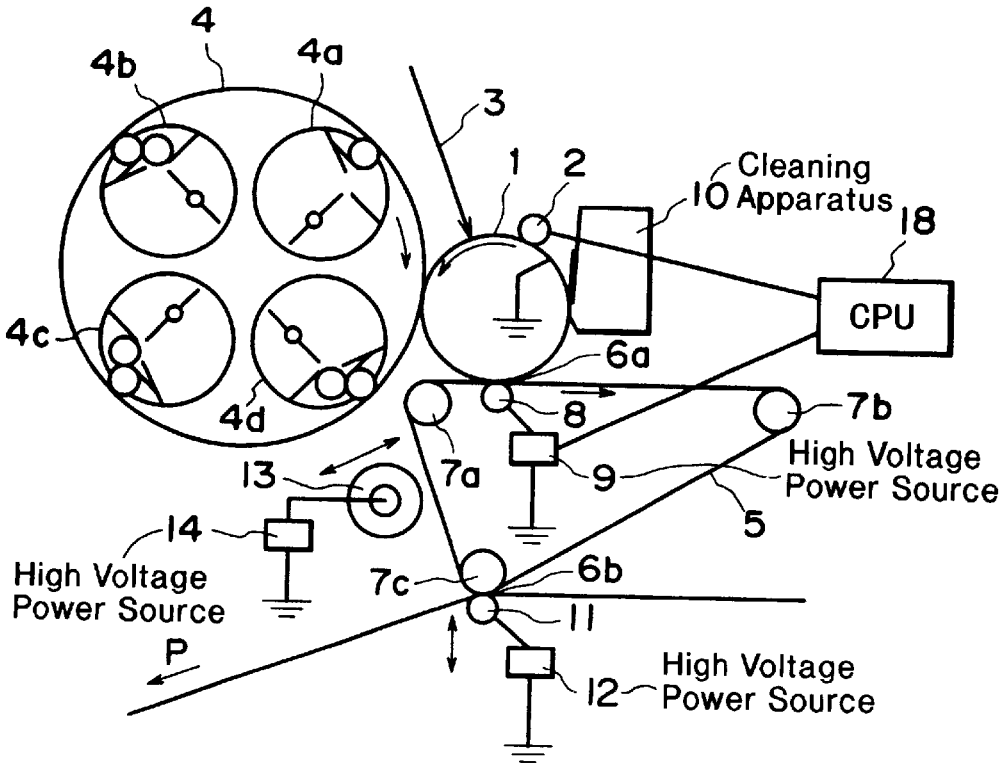
FIG. 1 is a schematic sectional view of a full-color image forming apparatus to which the present invention is applicable.

Hereinafter, the embodiments of the present invention will be described. FIG. 1 is a schematic sectional view of a full-color image forming apparatus compatible with the present invention.

In FIG. 1, a referential character 1 designates a photosensitive drum, which comprises a cylindrical base member formed of aluminum or the like material, and a layer of photosensitive material, for example, an organic photoconductor, coated on the peripheral surface of the base member. The photosensitive drum 1 is rotatively driven in the direction indicated by an arrow mark at a peripheral velocity of 120 mm/sec. First, its peripheral surface is uniformly charged by a charge roller 2 as a charging apparatus, to a potential level of approximately −700 V (dark portion potential level $V_D$). Then, the charged peripheral surface is scanned at an exposure point 3*a,* by a laser beam 3, which is turned on and off in response to the first image formation data. As a result, a first electrostatic latent image is formed on the peripheral surface of the photosensitive drum 1. The potential level of a light area of the electrostatic latent image is approximately −100 V. The electrostatic latent image formed in the above described manner is developed into a visual image by a developing apparatus 4. The developing apparatus 4 integrally comprises: a first developing device 4*a* which contains toner of black color as the first toner; a second developing device 4*b* which contains toner of magenta color as the second color; a third developing device 4*c* which contains toner of cyan color as the third color; a fourth developing device 4*d* which contains toner of yellow color as the fourth color. It also comprises a rotary moving means which makes it possible for each of these developing devices to be rotated to a development station to be switched with the one in the development station, in 1,200 milliseconds. The normal polarity to which the black, magenta, cyan, and yellow toners are charged is negative. The aforementioned first electrostatic latent image is developed into a visible image by the first developing device 4*a* in which black toner as the first toner is contained. As for the developing method, a jumping development method is used in combination with a reversal development process.

The black toner image, a visual image, is electrostatically transferred onto an intermediary transfer belt 5 as an intermediary transfer member, which is being rotatively driven in the direction of an arrow mark, at the first transfer point 6*a* at which the photosensitive drum 1 squarely face the intermediary transfer belt 5. The intermediary transfer belt 5 is constituted of an approximately 0.3–2 mm thick elastic base layer, and a 2–100 $\mu$m thick surface layer. The base layer is formed of urethane rubber, hydrin rubber, NBR (nitrile butadiene rubber), EPDM (copolymer of ethylene, propylene, and diene), or the like, which has a volumetric resistivity of $10^4$–$10^8$ Ω·cm, and the surface layer is formed of resin, for example, PVdF (polyvinylidene fluoride), PET (polyethyleneterephthalate), polycarbonate, polyethylene, silicon, and the like, which has a volumetric resistivity of $10^{10}$–$10^{14}$ Ω·cm. In order to prevent toner particles from being scattered from the toner image on the intermediary transfer belt, the volumetric resistivity of the resin layer is desired to be $10^{10}$–$10^{14}$ Ω·cm. The intermediary transfer belt 5 has a peripheral length of 441 mm, and is supported by supporting rollers 7*a,* 7*b,* and 7*c* (metallic rollers). It is placed in contact with the peripheral surface of the photosensitive drum 1 by the transfer roller 8 for primary transfer, with the application of a predetermined contact pressure, and is rotatively driven in the rotational direction of the photosensitive drum 1 at substantially the same peripheral velocity as that of the photosensitive drum 1. As a voltage (primary transfer bias) which has the opposite polarity to the normal charge polarity of the toner is applied to the transfer roller 8 for primary transfer from a high voltage power source 9, the toner image formed in the aforementioned manner is electrostatically transferred (primary transfer) onto the surface of the intermediary transfer belt 5.

Since the transfer roller 8 is in contact with the base layer of the intermediary transfer belt 5, at the first transfer point 6*a,* as described above, the potential level of the base layer of the intermediary transfer belt 5 becomes uniform along its entire length. The first transfer residual toner, that is, a small amount of toner which remains on the peripheral surface of the photosensitive drum 1 after the primary transfer, is removed by a cleaning apparatus 10.

The above described process is repeated three more times. As a result, a magenta toner image developed by the magenta toner, a cyan toner image developed by the cyan toner, and a yellow toner image developed by the yellow toner, are consecutively transferred in layers onto the surface of the intermediary transfer belt 5.

Next, a transfer roller 11 for secondary transfer, which has been kept away from the surface of the intermediary transfer belt 5 when not in action, is placed in contact with the surface of the intermediary transfer belt 5, with a predetermined contact pressure which is strong enough to press the intermediary transfer belt 5 against the support roller 7*c,* and begins to be rotatively driven. To the transfer roller 11 for secondary transfer, a voltage (secondary transfer bias) which has the opposite polarity to the normal charge polarity of toner is applied. As a result, the toner images, which have been consecutively transferred in layers onto the surface of the intermediary transfer belt 5 are transferred (secondary transfer) all at once onto the surface of a piece of transfer medium P which is being conveyed past the second transfer point 6*b* with a predetermined timing. Thereafter, the recording medium P is conveyed into an unillustrated fixing apparatus, in which the toner images are permanently fixed to the recording medium P. Finally, the recording medium with fixed toner images is discharged out of the image forming apparatus.

Figure 2:
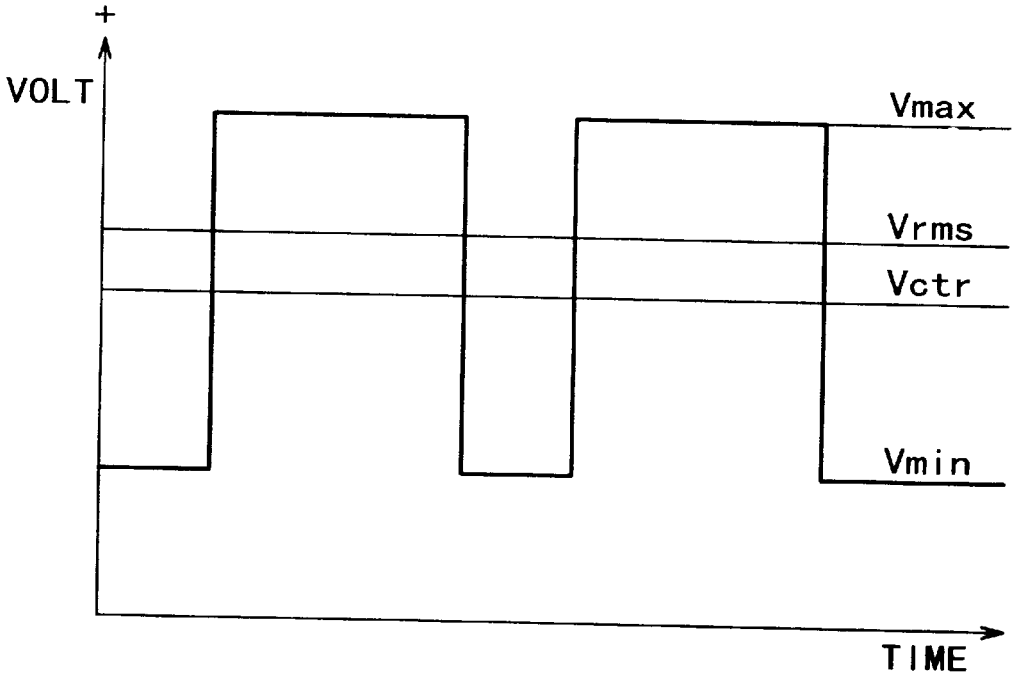
FIG. 2 is a graphic drawing which shows the wave-form of the bias applied to a cleaning roller.

The secondary transfer residual toner, that is, a small amount of the toner which remains on the surface of the intermediary transfer belt 5 after the secondary transfer, is charged by a cleaning roller 13, which is placed in contact with the surface of the intermediary transfer belt 5 with a predetermined timing by an unillustrated driving means. This cleaning roller 13 comprises a metallic core, a 2–6 mm thick elastic layer coated on the metallic core, and a 10–300 $\mu$m thick surface layer coated on the elastic layer. The elastic layer is formed of elastic material such as rubber or sponge, which has a volumetric resistivity of $10^4$–$10^6$ Ω·cm, and the surface layer is formed of rubber, resin, or the like, which has a volumetric resistivity of $10^6$–$10^{12}$ Ω·cm. While the toner images on the peripheral surfaces of the photosensitive drum 1 are consecutively transferred (primary transfer) onto the surface of the intermediary transfer belt 5, the cleaning roller 13 is kept away from the surface of the intermediary transfer belt 5. Then, after the simultaneous transfer (secondary transfer) of all the toner images on the intermediary transfer belt 5 onto the surface of the recording medium P, the cleaning roller 13 is pressed against the intermediary transfer belt 5, and bias is applied to the cleaning roller 13 by a high voltage power source 14. It is desired that the bias applied to the cleaning roller 13 is a compound voltage composed of an AC voltage and a DC voltage as illustrated in FIG. 2, in other words, an alternating voltage with a rectangular wave-form. In FIG. 2, a referential character $V_{max}$ represents the maximum voltage value; $V_{min}$: the minimum voltage value; $V_{ctr}$: the average value between the maximum value $V_{max}$ and the minimum value $V_{min}$; and a referential character $V_{rms}$ represents the effective voltage value. The apparatus is configured so that the application of alternating voltage with an asymmetrical wave-form causes the effective voltage value $V_{rms}$ to be different from the average value $V_{ctr}$. With the above configuration, the second transfer residual toner which remains on the surface of the intermediary transfer belt 5 is charged to the opposite polarity (positive) relative to the normal charge polarity of the toner, and is transferred back onto the peripheral surface of the photosensitive drum 1 from the surface of the intermediary transfer belt 5. More specifically, the second transfer residual toner which has resulted from the preceding toner image formation cycle is transferred back onto the peripheral surface of the photosensitive drum 1 at the same time as a toner image, for example, the black toner image developed by the black toner, in the current toner image formation cycle, is transferred (primary transfer) from the peripheral surface of the photosensitive drum 1 onto the surface of the intermediary transfer belt 5. After the reversal transfer, the secondary transfer residual toner, which now is on the peripheral surface of the photosensitive drum 1, is recovered by a cleaning apparatus (blade) for the photosensitive drum 1, which completes the process for cleaning the secondary transfer residual toner which remains on the surface of the intermediary transfer belt 5. When the image forming operation is not continued further, the secondary transfer residual toner on the intermediary transfer belt 5 is transferred back onto the photosensitive drum 1 without carrying out the primary transfer.

Next, the toners in this embodiment will be described.

The black toner in this embodiment is a single component magnetic toner composed of microscopic particles which contain carbon black magnetite, etc. It is formed by pulverization. Its particle diameter is approximately 4–8 μm, and it has an electrostatic capacity of −10 μC/g.

The other toners, that is, the magenta, cyan, and yellow toners, are manufactured with the use of suspension polymerisation, for example, and contain a substance with a low softening point by 5–30 (wt. %). They are nonmagnetic single component polymer toner, the shape factors SF1 and SF2 of which are 100–120, and the particle diameters of which are 5–7 mμm. In other words, they are composed of virtually spherical particles.

Figure 3:
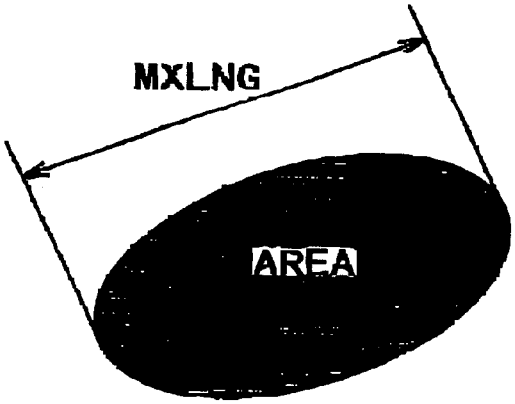
FIG. 3 is a schematic drawing which gives the definition of a shape factor SF1.
Figure 4:
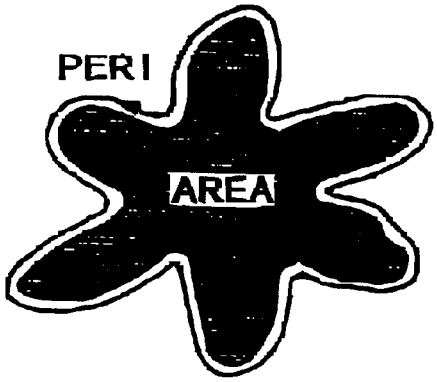
FIG. 4 is a schematic drawing which gives the definition of a shape factor SF2.

The aforementioned shape factor SF1 is such a numerical value that indicate in ratio the degree of the roundness of a spherical object as shown in FIG. 3; it is a value obtained by dividing the square of the maximum cross sectional length MXLNG of the oval shape which results when a spherical object is projected onto a two dimensional plane, by the area AREA of the oval shape, and then, multiplying by 100 π/4.

In other words, the shape factors are defined by the formula (4) given below.

$$SF1=\{(\mathrm{MXLNG})^2/\mathrm{AREA}\}\times(100\ \pi/4) \quad (4)$$

The shape factor SF2 is a numerical value which indicates in ratio the degree of the irregularity in the shape of an object; it is a value obtained by dividing the peripheral edge length PERI of the shape which results when an object is projected onto a two dimensional plane, by the area AREA of the projected shape, and then, multiplying by 100/4π.

In other words, it is defined by a formula (5) given below.

$$SR2=\{(\mathrm{PERI})2/\mathrm{AREA}\times(100/4\pi) \quad (5)$$

In this embodiment, the shape factors are calculated in the following manner. First, 100 toner images were randomly selected with the use of an FE-SEM (S-800) (Hitachi, Ltd.), and the image data of the samples were fed into an image analysis apparatus (LUSEX3) (Nikon Corp.). Then, the results of the analysis were substituted into the formulas (4) and (5).

Figure 5:
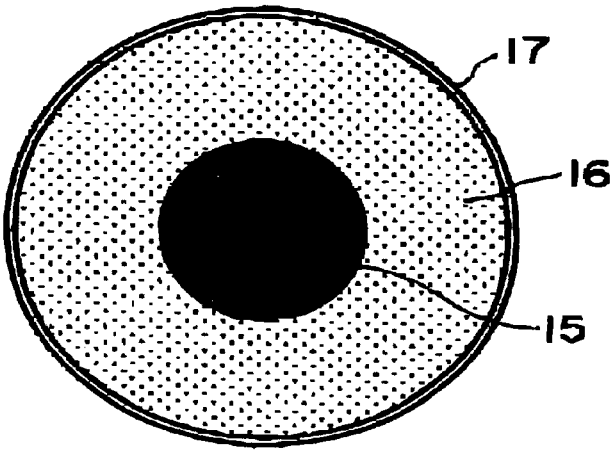
FIG. 5 is a schematic sectional view of a polymer toner particle, and depicts the structure thereof.

The general structure of a particle of the aforementioned polymer toner is illustrated in FIG. 5. The particles of polymer toner become approximately spherical due to the manufacturing method of polymer toner. In this embodiment, polymer toner was composed of particles which comprise a core 15 of ester wax, a resin layer 16 of styrene acrylate, and a surface layer 17 of styrene-polyester, layered in this order from inside. Its specific gravity was 1.05. The provision of the central wax core 15 was effective to prevent the toner particles from off-setting during the fixing process, and the provision of the surface layer 17 of resin could improve the charge efficiency of the toner. Further, the toner in this embodiment was mixed with oil treated silica to stabilize the electrostatic capacity of the toner. The electrostatic capacity of the toner was approximately −40 μC/g.

Hereinafter, the printing sequences employed by a full-color image forming apparatus in accordance with the present invention will be described in detail.

Figure 6:
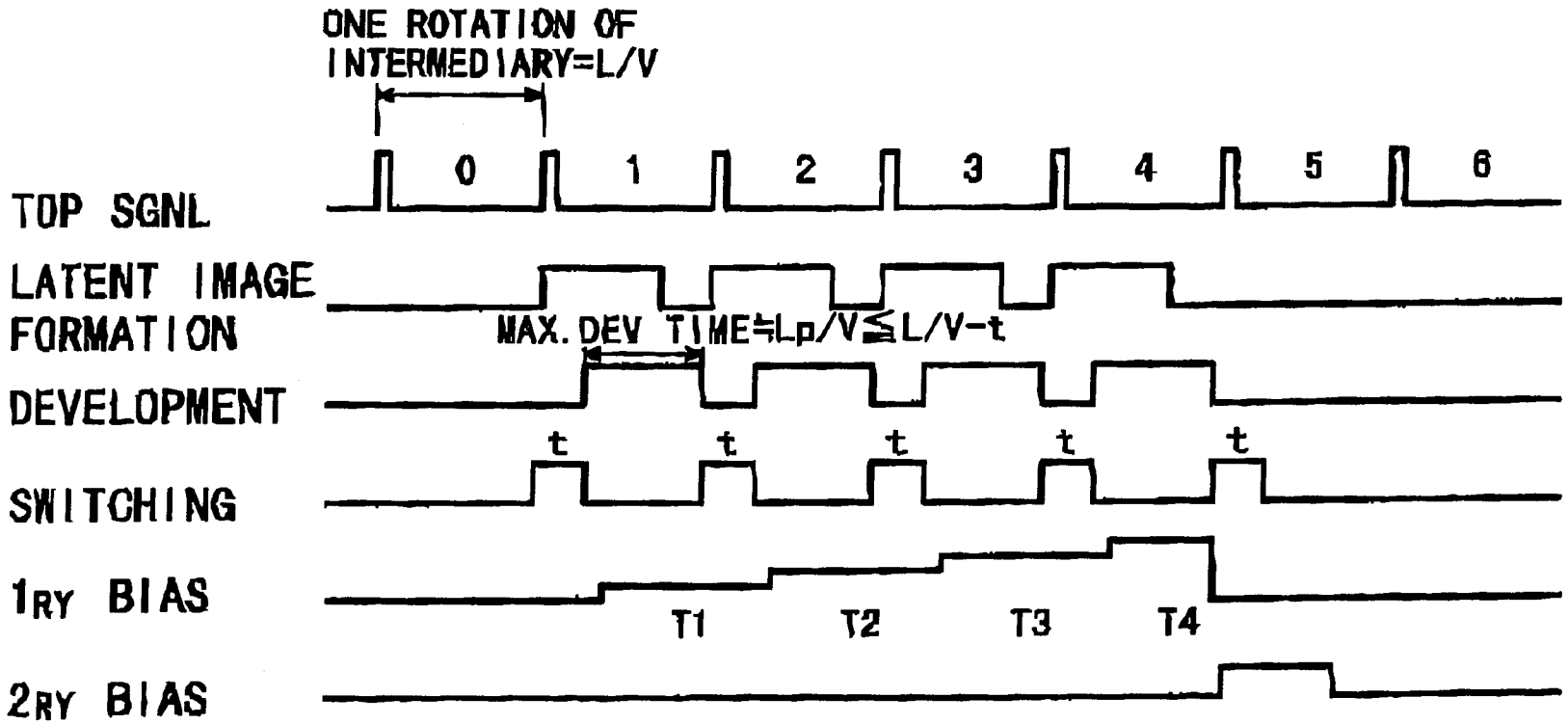
FIG. 6 is a diagram for describing a normal sequence in accordance with the present invention.

First, in this embodiment, the transfer medium size, in particular, the length in the transfer medium conveyance direction, is detected by an unillustrated sheet size detecting means, and the detected length is sent to a controlling apparatus 18, which selects one of two image formation modes (sequences) on the basis of the detected sheet length. More specifically, provided that the peripheral length of the intermediary transfer belt 5 in this embodiment is 441 mm, when forming a full-color image on a sheet of recording medium, as long as the length of the sheet does not exceed the length of an A4 size sheet, it satisfies Formula (1). Therefore, it is unnecessary to idle one full turn after each primary transfer. Thus ,the normal sequence depicted in FIG. 6 is carried out.

Figure 7:
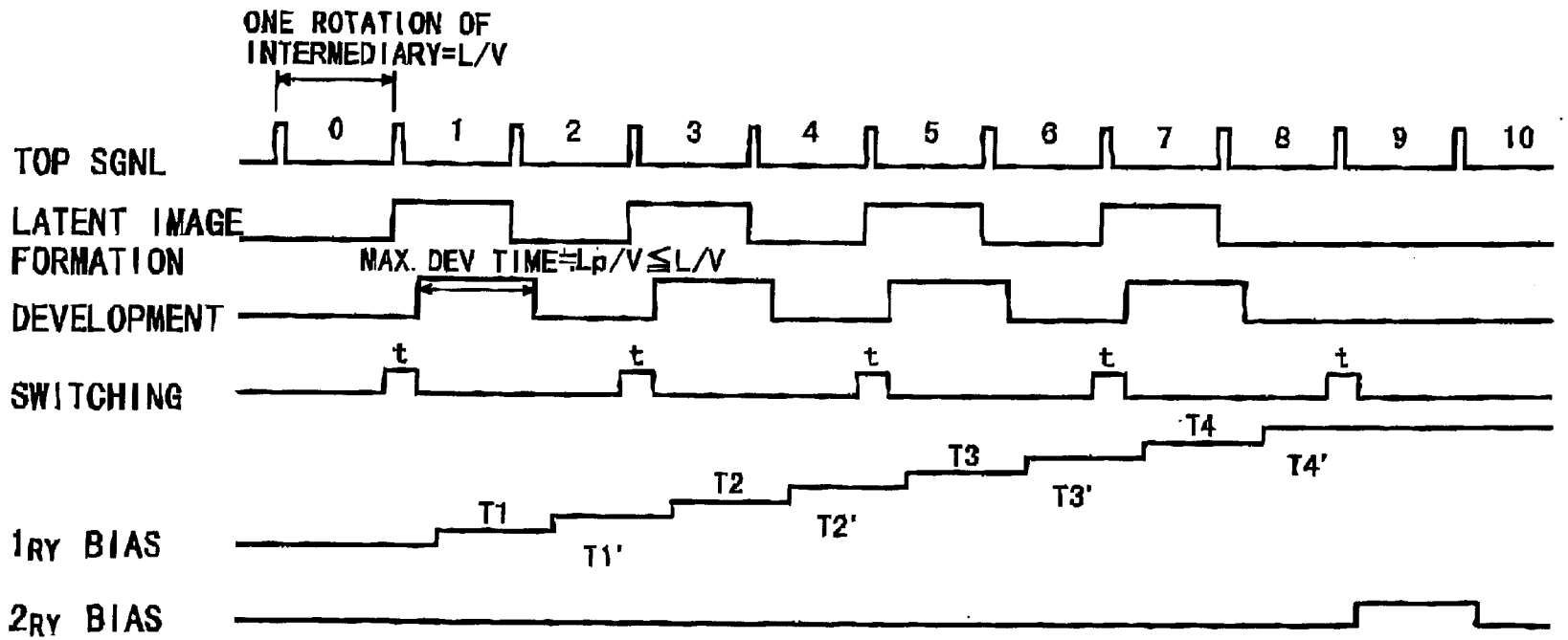
FIG. 7 is a diagram for describing the sequence for a large piece of recording medium, in the first embodiment.
Figure 8:
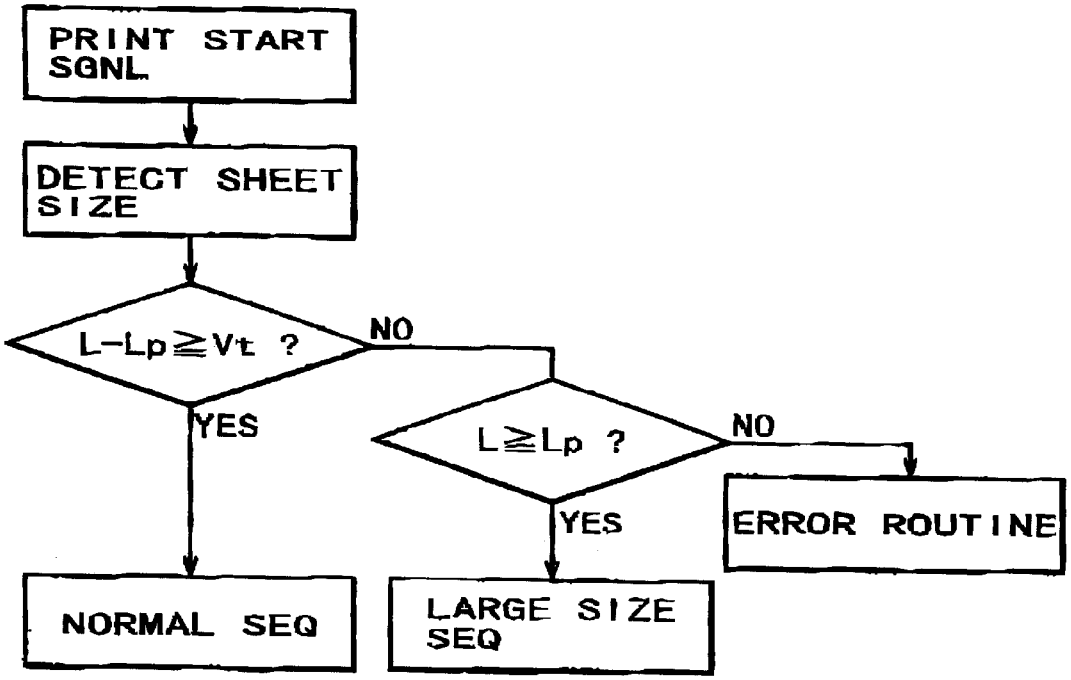
FIG. 8 is a flow chart of a sequence for selecting a pertinent image printing sequence.

However, when forming a full-color image on a sheet of recording medium which exceeds in length an A4 size sheet, it is necessary to idle the intermediary transfer belt 3 for each primary transfer. Thus, the sequence for a large size sheet illustrated in FIG. 7 is carried out. In the sequence for a large size sheet, the primary transfer for each color is carried out during every second turn of the intermediary transfer belt 5, so that a full-color image can be formed even on a sheet of recording medium which does not satisfy Formula (1). In other words, all that is necessary is to provide an image forming apparatus with a capability to determine whether or not a sheet of recording medium is longer than an A4 sheet prior to the starting of the primary transfer. Therefore, one of the known sheet size detecting means may be employed as the sheet size detecting means for an image forming apparatus in accordance with the present invention. For example, a sheet size detection roller, the movement of which reflects the recording medium size, may be placed in sheet cassette for storing sheets of recording medium, so that the sheet size information is sent to the controlling apparatus 18. The flow chart for the sequence for determining the sheet size is given in FIG. 8.

Further, this embodiment of the present invention is characterized in that the potential level $T_1'$ of the primary transfer bias applied at the first transfer point during the non-transfer period, is made higher than the potential level $T_1$ of the primary transfer bias applied at the first transfer point during the primary transfer of the black toner image, that is, the toner image of the first color, the electrostatic capacity of which is the smallest among the four color toners.

$$T_1<T_1' \quad (6)$$

More specifically, an arrangement was made so that the potential levels of $T_1$ and $T_1'$ becomes: $T_1$=+150 (V), whereas, $T_1$=+250 (V). The research by the inventors of the present invention revealed that when an arrangement was made so that $T_1=T_1'+150$ (V) was satisfied, the so-called reversal transfer phenomenon, the phenomenon that toner transfers back from the surface of an intermediary transfer belt onto the peripheral surface of a photosensitive drum, is liable to occur, but when the level of the transfer bias applied during the idling of the intermediary transfer belt was raised as described above, the reversal transfer phenomenon could be prevented. This is thought to have occurred because such an arrangement increased the force which held fast the toner to the surface of the intermediary transfer belt. More specifically, it is thought that when the toner on the surface of the intermediary transfer belt was passed through the nip, that is, the interface between the intermediary transfer belt and the photosensitive drum, during the period in which the intermediary transfer belt was idled, the potential level of the toner was raised by the electrical charge given to the toner by the electrical discharge which occurred when the intermediary transfer belt and the photosensitive drum separated from each other near the nip (primary transfer nip), and this increase in the potential level of the toner contributed to the prevention of the reversal transfer phenomenon. Regarding the toners other than the black toner, because their electrostatic capacities are inherently high relative to the black toner, the reversal transfer phenomenon is not likely to occur. Thus, the potential level of the primary transfer bias applied at the first transfer point during the transfer process may be made substantially the same as the potential level of the primary transfer bias applied during the non-transfer period which immediately follows the primary transfer period. However, in order to assure that the reversal transfer phenomenon does not occur, it is desired that, compared to the potential level $T_1$ of the primary transfer bias applied at the first transfer point, the potential level $T_1'$ of the primary transfer bias for the non-transfer period which immediately follows the primary transfer period is set to be higher.

It is also desired that the potential level $T_1'$ of the primary transfer bias for the non-transfer period is set to be lower than the potential level $T_2$ of the primary transfer bias for transferring (primary transfer) the magenta toner image, that is, the toner image of the second color, from the photosensitive drum 1 to the intermediary transfer belt 5. This is for the following reason. That is, assuming that $T_1>T_2$, as a transfer bias with a potential level of $T_1'$ ($>T_2$) is applied to the transfer rollers 8 for primary transfer during the idling of the intermediary transfer belt 5 (non-transfer period) after the primary transfer of the black toner image, that is, the toner image of the first color, an intermediary transfer belt, such as the one in this embodiment, ($10^8$–$10^{14}$ Ω·cm, preferably, $10^{10}$–$10^{14}$ Ω·cm, in volumetric resistivity) is charged up, which affects the primary transfer of the toner image of magenta color, the second color. In other words, a primary transfer bias with the higher potential level $T_2$ becomes necessary, which in turn makes it necessary to correspondingly increase the potential levels $T_3$ and $T_4$ of the transfer biases for the transfer of the toner images of the rest of the colors. Therefore, the capacity of the high voltage power source 9 must be increased so that larger transfer bias can be applied. This leads to cost increase. In addition, if the bias is increased beyond a certain level, electrical discharge occurs adjacent to the nip during primary transfer, which results in an unsatisfactory transfer.

As described, an excellent full-color image, that is, an image which does not suffer from such imperfections as the under saturation of color can be formed on a large piece of recording medium, which doe snot satisfy Formula (1), by setting the potential level $T_1'$ of the primary transfer bias applied at the primary transfer point during the non-transfer period which follows the transfer period, to be larger than the potential level $T_1$ of the primary transfer bias applied at the primary transfer point during the transfer period.

Further, after the completion of the primary transfer of the toner image of yellow color, the fourth color, the intermediary transfer belt 5 is idled one full turn to make the potential level of the yellow toner substantially the same as the potential levels of the toners of the first to third colors, which have become high due to the repetition of the primary transfer, so that color aberration or the like does not occur during the secondary transfer. With this arrangement, the secondary transfer process is not carried out while a toner image of yellow color, the fourth color, is transferred (primary transfer) onto the intermediary transfer belt 5 to form a full-color image on a piece of recording medium of a size which does not satisfy Formula (1). Therefore, the potential level of the base layer of the intermediary transfer belt 5 becomes approximately uniform across its entire length, which eliminates a problem peculiar to the structure in accordance to the present invention, that is, increase in the size of the high voltage power source 12. Further, such a problem that the shock which occurs the moment the transfer roller 11 for secondary transfer comes in contact with the intermediary transfer belt 5 during a primary transfer period negatively affects the transfer can be prevented.

Although an intermediary transfer member in the form of a belt was employed in this embodiment, it is obvious that an intermediary transfer member in the form of a drum may be employed.

Embodiment 2

Hereinafter, another embodiment of the present invention will be described. The same members as those in the first embodiment will be given the same referential characters so that their description can be omitted. This embodiment is characterized in that the condition of the environment in which a full-color image forming apparatus is operated is automatically detected, and then, based on the results of the detection, that is, the ambient condition, the potential level $T_1'$ of the primary transfer bias to be applied at the primary transfer point during the non-transfer period, which follows the primary transfer period for transferring (primary transfer) an image composed of the toner with the smallest electrostatic capacity, is set to be higher than the potential level $T_1$ of the transfer bias to be applied during the primary transfer period applied at the primary transfer point. In addition, the difference in the potential ($T_1'$–$T_1$) by which the potential level $T_1'$ is raised is made variable. The object of this embodiment is also to provide an image forming apparatus capable of forming high quality full-color images even on a large piece of recording medium which does not satisfy Formula (1). More specifically, in a high temperature-high humidity environment in which the aforementioned reversal transfer phenomenon is liable to occur, the occurrence of that phenomenon is prevented by increasing the difference ($T_1'$–$T_1$), whereas in a low temperature-low humidity environment, the difference ($T_1'$–$T_1$) is kept as small as possible within the range in which the reversal transfer phenomenon does not occur. This is for the following reason. That is, if the potential level of the bias applied at the first transfer point during the non-transfer period is raised to the same potential level as that for the high temperature-high humidity environment, electrical discharge is liable to occur through the air gap between the photosensitive drum and the intermediary transfer belt, which results in the formation of an aberrant image.

At this time, a means for automatically detecting the environmental information for varying the aforementioned difference ($T_1'$–$T_1$) will be described. As described above, the full-color image forming apparatus in this embodiment is provided with a charge roller 2 as a charging apparatus as in the first embodiment. Generally, the material for the charge roller 2 is characterized in that its resistance value greatly fluctuates is response to the change in its ambience. Thus, the present invention utilizes the charge roller 2 as the means for automatically detecting the ambient conditions.

Figure 9:
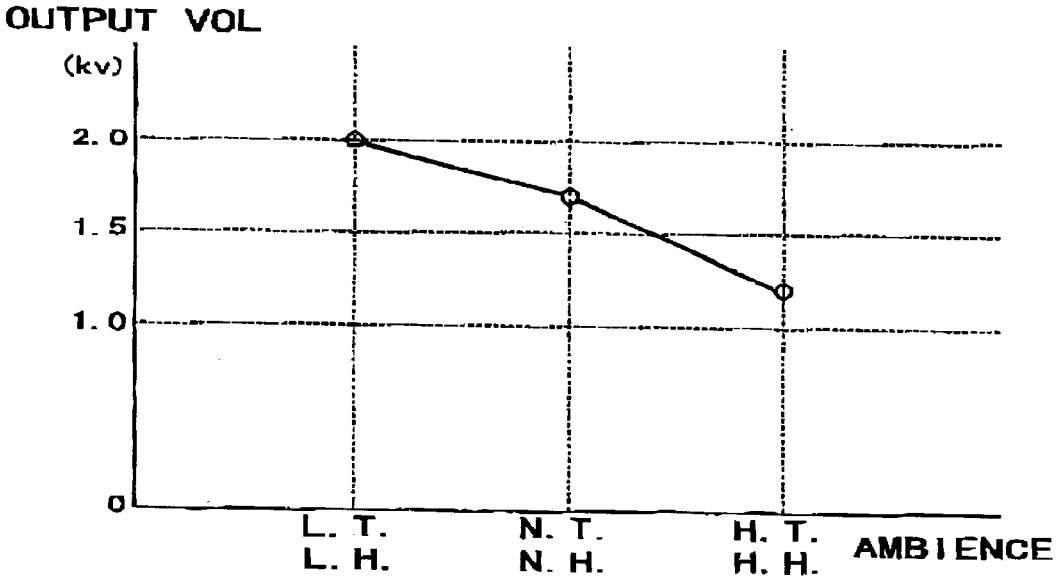
FIG. 9 is a graph which shows that the resistance value of a charge roller depends on environmental factors.

More specifically, the electrical resistance of a charge roller tends to increase as the ambient temperature and/or humidity of the charge roller decreases, whereas it tends to decrease as the ambient temperature and/or humidity increases. Therefore, the state of the ambience in which an image forming apparatus is disposed can be determined by detecting the electrical resistance of the charge roller. Given in FIG. 9 are the results of a test which was conducted to study the ambience dependency of the potential level which is necessary to flow a constant current of −20 μA through the charge roller while the charge roller is in contact with the non-image forming portion of the photosensitive drum. According to FIG. 9, the potential level necessary in an environment with the normal temperature and humidity was −1.7 kV, whereas is a low temperature-low humidity environment in which the electric resistance value of the charge roller was high, it was −2.0 kv, which is rather high. On the contrary, in a high temperature-high humidity environment in which the electrical resistance of the charge roller was relatively low, it was −1.2 KV. Based on this fluctuation in the electrical resistance of the charge roller, it is possible to determine the ambient condition of an image forming apparatus by detecting whether the detected potential level is higher or lower than the predetermined potential level. Then, all that is necessary is to feed the thus obtained information regarding the ambient condition of the image forming apparatus back to the controlling apparatus, to set the difference in potential level by which the potential level of the primary transfer bias to be applied during the non-transfer period is raised.

Figure 10:
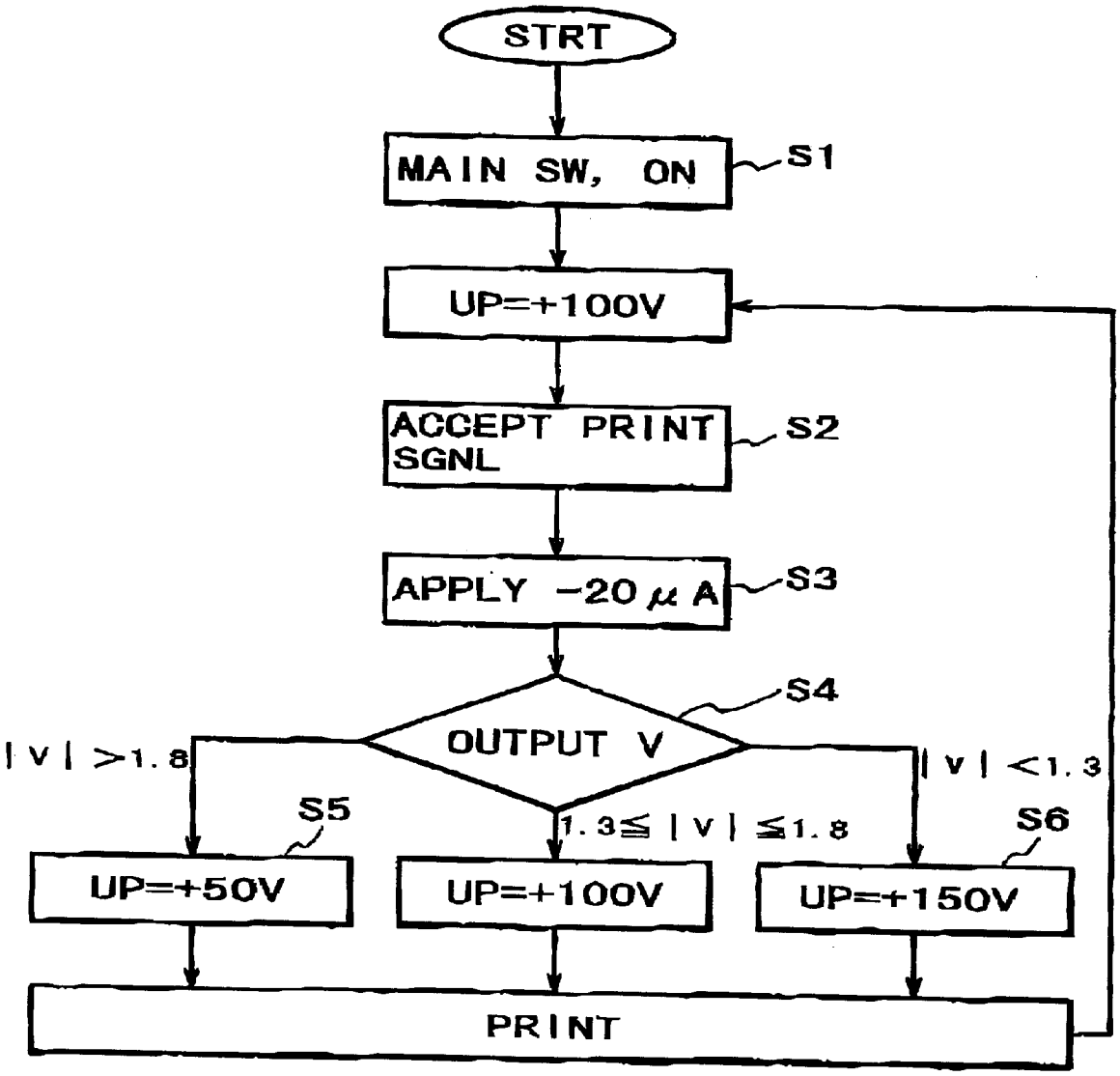
FIG. 10 is a flow chart for determining the amount by which the voltage level for the non-transfer period is adjusted on the basis of the ambient condition.

FIG. 10 shows the flow chart for the above described control. In this embodiment, on the basis of the above described test, and the fluctuation of the electrical resistance of the charge roller, the bottom limit of the voltage output level below which the ambient environment of the image forming apparatus was considered to be a low temperature-low humidity environment was set at −1.8 (kv), and the top limit of the voltage output level above which the ambient environment of the image forming apparatus was considered to be a high temperature-high humidity environment was set at −1.3 (kv). In operation, first, the power source of the image forming apparatus was turned on (S1). Than, after the image forming apparatus reached the stand-by state, it received a print signal from an unillustrated host (S2), and started rotating the photosensitive drum. Next, a DC bias controlled to flow a constant current of −20 ($\mu$A) was applied to the charge roller (S3). Then, when the absolute value of the voltage output level was greater than −1.8 (kv), the ambient environment was determined to be a low temperature-low humidity environment, and a potential level of +200 (v), which was the result of an addition of +50 (v) to the potential level of +150 (v) of the primary bias for the transfer period, was set as the potential level for the primary bias for the non-transfer period (S5). On the contrary, when the voltage output level was less in absolute value than −1.3 (kv), the environment in the image forming apparatus was determined to be a high temperature-high humidity environment, and a potential level of +300, which was an additional +150 (v) to the voltage value of +150 (v) of the primary transfer bias for the transfer period, was set as the potential level for the primary transfer bias for the non-transfer period (S6).

By varying the amount by which the potential level of the primary transfer bias for the non-transfer period is raised relative to the potential level for the primary transfer bias for the transfer period according to the ambient condition of the charge roller, the reversal transfer phenomenon which is liable to occur in a high temperature-high humidity environment, the production of aberrant images which occurs in a low temperature-low humidity environment, and the like phenomenon, can be prevented, so that high quality images can be formed on a large piece of transfer medium which does not satisfy formula (1).

As described, in this embodiment, while the charge roller 2 was in contact with the non-image forming portion of the photosensitive drum, a DC bias controlled to flow a constant current of a predetermined value was applied to the charge roller 2, so that the ambient condition of the charge roller 2 could be determined from the detected potential level of the DC bias. Obviously, however, an image forming apparatus may be configured so that the state of the ambient condition of the charge roller 2 may be determined on the basis of the amount of the current which flows when a DC bias controlled so that its potential level remains at a predetermined level is applied to the charge roller.

Further, instead of relying on the state of the ambient condition of the charge roller determined by the above described method, the voltage level control may be carried out on the basis of the temperature and humidity detected by placing a temperature sensor and a humidity sensor within the image forming apparatus.

However, using the charge roller 2 to detect the ambient condition eliminates the need for the provision of the aforementioned temperature sensor and humidity sensor, which prevents cost increase.

Embodiment 3

Next, another embodiment of the present invention will be described. Also in this embodiment, the same members as those described in the first embodiment will be given the same referential characters so that their description can be omitted here. In this embodiment, in addition to setting the potential level $T_1'$ of the primary transfer bias for the non-transfer period immediately following the transfer period, at a higher level then the potential level $T_1$ of the primary transfer bias applied at the primary transfer point during the transfer period, the intermediary transfer belt 5 was made pivotable about one of the supporting rollers with the provision of an unillustrated separation cam, so that the photosensitive drum 1 and the intermediary transfer belt 5 can be separated from each other. With this arrangement, the photosensitive drum 1 and the intermediary transfer belt 5 can be separated from each other to prevent the reversal transfer phenomenon. However, it the distance by which the photosensitive drum 1 and the intermediary transfer belt 5 are separated from each other is extremely small, the toner image on the surface of the intermediary transfer belt 5 is liable to be disturbed in spite of the presence of the gap between the photosensitive drum 1 and intermediary transfer belt 5. In order to prevent this phenomenon, it is extremely effective to configure an image forming apparatus so that, compared to the potential level $T_1$ of the primary transfer bias applied at the primary transfer point during the transfer period in which an image formed of the toner with the least electrostatic capacity is transferred, the potential level $T_1'$ of the primary transfer bias for the non-transfer period which follows such a transfer period can be set at a higher level.

It is obvious that the configuration in this embodiment may be employed in conjunction with the configuration in the first embodiment.

Embodiment 4

Figure 11:
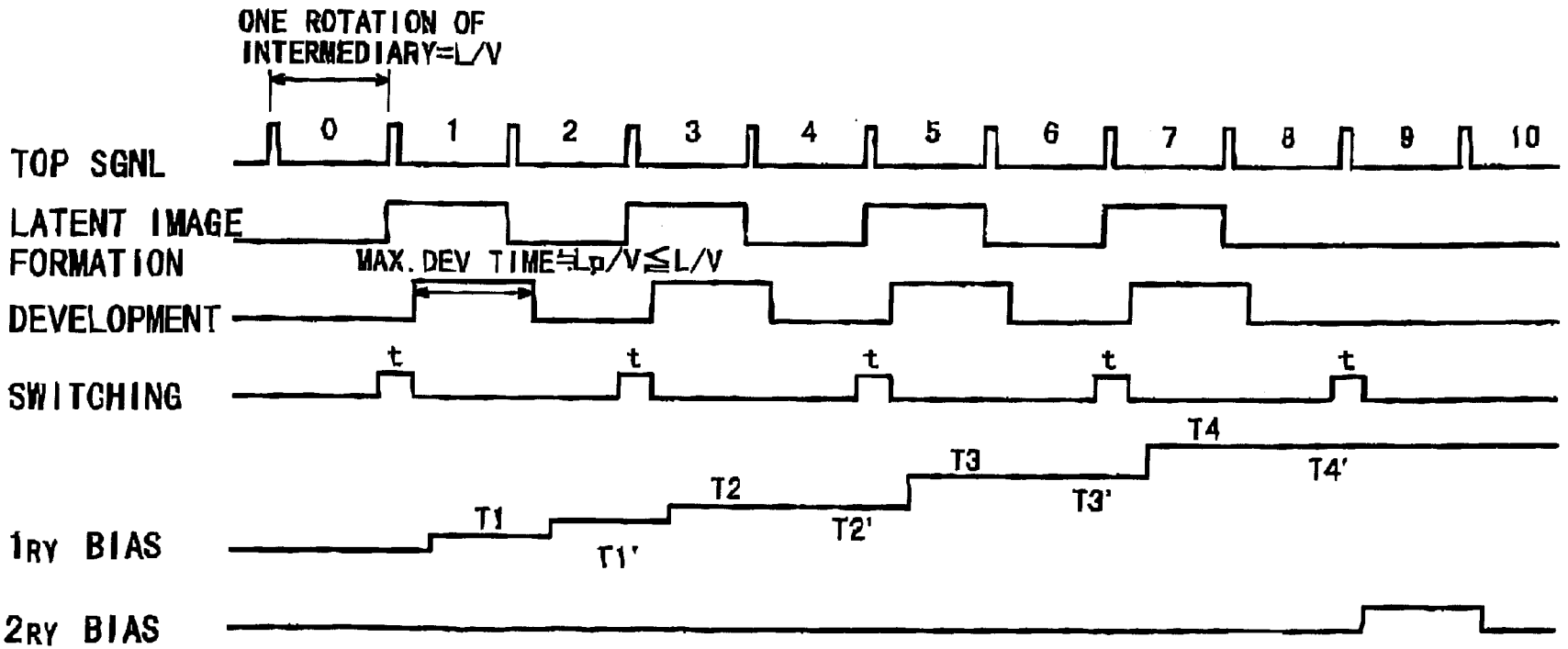
FIG. 11 is a diagram for describing the sequence for a large piece of transfer medium, in the fourth embodiment.
Figure 12:
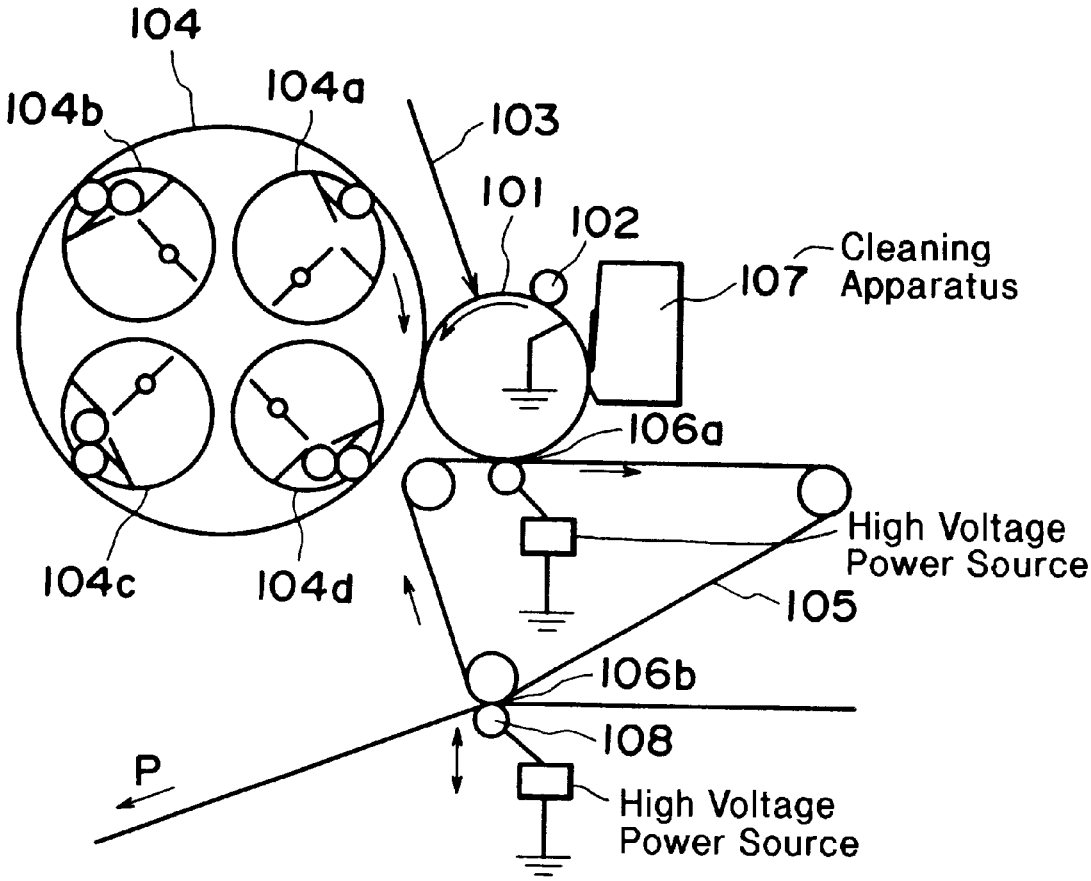
FIG. 12 PRIOR ART
FIG. 12 is a schematic sectional view of a conventional full-color image forming apparatus, and depicts the general structure thereof.

Referring to FIG. 7, the potential levels $T_1'$, $T_2'$, $T_3'$, and $T_4'$ of the biases applied during the non-transfer periods after the secondary transfer of the tuner images of the first to fourth colors, correspondingly, were set to be higher than the potential levels $T_1$, $T_2$, $T_3$, and $T_4$ of the biases applied during the primary transfer periods, correspondingly, as in the first embodiment. However, in order to form a full-color image on a large sheet of recording medium which does not satisfy Formula (1), the image formation sequence such as the one presented in FIG. 11, may be carried out. In other words, since the electrostatic capacity of the toner of black color, the first color, is relatively small compared to those of the toners of the second to fourth color toners, the bias potential level $T_1'$ is set to be higher than the potential level $T_1$, whereas since the electrostatic capacities of the other color toners are inherently higher than that of the black toner, the bias potential levels $T_2'$, $T_3'$, and $T_4'$ are set to be substantially the same as the bias potential levels $T_2$, $T_3$, and $T_4$, so that the potential levels of the toners do not become excessively high at the first transfer point 6*a*. Thus, the potential levels of the color toners become proper; they do not become excessively high. As a result, the secondary transfer efficiency is improved while preventing the reversal transfer of the toner particles onto the photosensitive drum.

As described above, a desirable full-color image, that is, an image with no defect, can be formed even on a large sheet of recording medium, which does not satisfy Formula (1), by controlling the potential level of the bias applied during the non-transfer process, which immediately follows the primary transfer process, to be larger than, or substantially the same as, the potential level of the bias applied during the primary transfer process, in response to the internal humidity of an image forming apparatus, or the potential level of the toner (potential level of the toner particles in the developing devices, or the toner particles of the toner image formed on the photosensitive drum), with the use of controlling apparatus 18.

With the provision of this arrangement, an image forming apparatus can deal even with the fluctuation of the potential level of the toner which occurs in response to the fluctuation of ambience (humidity).

The potential levels $T_1'$ and $T_1$ may be changed in response to environment (humidity) as they were in the second embodiment.

Further, the potential level of the primary transfer bias applied during the non-transfer process may be controlled to be higher than, or substantially the same as, the potential level of the bias applied during the primary transfer process, in response to the potential level of the toner image formed on the photosensitive drum, measured with the use of a potential level sensor (unillustrated) after the toner image formation, but prior to the primary transfer, and fed back to the controlling apparatus (CPU) 18.

While the invention has been described with reference to the structure disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a movable intermediary transfer member;

voltage applying means for applying a voltage to said intermediary transfer member to sequentially effect overlapping transfer of a plurality of toner images from said image bearing member to said intermediary transfer member at a transfer position, wherein the plurality of toner images are transfer onto a transfer material from said intermediary transfer member; and control means for controlling the voltage applied to said intermediary transfer member from said voltage applying means such that an absolute value of the voltage in larger than the voltage for transferring a first toner image from said image bearing member onto said intermediary transfer member, when the first toner image on said intermediary transfer member passes through the transfer position in a period which is after the first toner image is transferred from said image bearing member onto said intermediary transfer member and which is before a second toner image next to the first toner image is transferred onto said intermediary transfer member.

2. An apparatus according to claim 1, wherein the voltage applied to said intermediary transfer member from said voltage applying means is larger when the second toner is transferred from said image hearing member onto said intermediary transfer member than when the first toner image on said intermediary transfer member passes through the transfer position in the period.

3. An apparatus according to claim 1 or 2, wherein said control means is operative to select either a first mode in which the first toner image on said intermediary transfer member passes through the transfer position during the period or a second mode in which the second toner image is transferred from said image bearing member onto acid intermediary transfer member when the first toner image on said intermediary transfer member passes next time the transfer position.

4. An apparatus according to claim 3, further comprising detecting means for detecting a length of the transfer material in a direction of feeding thereof, wherein said control means selects the mode in accordance with an output of said detecting means.

5. An apparatus according to claim 3, wherein said control means selects the mode in accordance with a length of the transfer material measured in a direction of feeding thereof.

6. An apparatus according to claim 5, wherein when the length of the transfer material is longer than a predetermined length, said control means selects the first mode.

7. An apparatus according to claim 6, further comprising first developing means for forming the first toner image on said image bearing member at a developing position, second developing means for forming the second toner image on said image bearing member at the developing position, and moving means for selectively moving said first developing means and said second developing means to the developing position.

8. An apparatus according to claim 7, wherein a circumferential length L of said intermediary transfer member, a time period t from a completion of formation of the first toner image on said image bearing member by said first developing means at the developing position to completion of movement of said second developing means by said moving means to said developing position, a rotational speed V of said intermediary transfer member, and the length Lp of the transfer material, satisfy:

$$L-Lp<V\times t.$$

9. An apparatus according to claim 6, wherein said control means controls the voltage applied to said intermediary transfer member from said voltage applying means when the first toner image on said intermediary transfer member passes through the transfer position in the period.

10. An apparatus according to claim 9, further comprising humidity detecting means for detecting a humidity in said apparatus, wherein said control means controls the voltage in accordance with an output of said humidity detecting means.

11. An apparatus according to claim 6, further comprising charging means for contacting a surface of said image bearing member to electrically charge the surface of said image bearing member, wherein said control means controls the voltage during the period in accordance with a current through said charging means when a predetermined voltage is applied to said charging means.

12. An apparatus according to claim 6, further comprising first charging means for contacting a surface of said image bearing member to electrically charge the surface of said image bearing member, wherein said control means controls the voltage during the period in accordance with a voltage across said charging means when a predetermined current is applied through said charging means.

13. An apparatus according to claim 6, wherein said intermediary transfer member is movable between a first position in which it is contacted to said image bearing member at the transfer position to transfer the toner image from said image hearing member onto said intermediary transfer member and a second position in which said intermediary transfer member is away from said image bearing member.

14. An apparatus according to claim 13, wherein said intermediary transfer member moves to the second position before the first toner image on said intermediary transfer member passes through the transfer position during the period.

15. An apparatus according to claim 5, wherein when a length of a transfer material measured in a direction of feeding thereof is smaller than a predetermined length, said control means selects the second mode.

16. An apparatus according to claim 15, further comprising first developing means for forming the first toner image on said image bearing member at a developing position, second developing means for forming the second toner image on said image bearing member at the developing position, and moving means for selectively moving said first developing means and said second developing means to the developing position.

17. An apparatus according to claim 16, wherein a circumferential length L of said intermediary transfer member, a time period t from a completion of formation of the first toner image on said image bearing member by said first developing means at the developing position to completion of movement of said second developing means by said moving means to said developing position, a rotational speed V of said intermediary transfer member, and the length Lp of the transfer material, satisfy:

$$L-Lp \geqq V \times T.$$

18. An apparatus according to claim 1, further comprising charging means for charging residual toner remaining on said intermediary transfer member to a plurality opposite from a regular charge polarity of the toner after the toner images are transferred from said intermediary transfer member on the transfer material, wherein said voltage applying means forms an electric field, at the transfer position, effective to transfer the residual toner charged by said charging means from said intermediary transfer member back onto said image hearing member.

19. An apparatus according to claim 18, wherein said voltage applying means forms an electric field, at the transfer position, effective to transfer a next toner image from said image bearing member onto said intermediary transfer member and simultaneously to transfer the residual toner charged by the charging means from said intermediary transfer member onto said image bearing means.

20. An apparatus according to claim 1, wherein said intermediary transfer member has a volume resistivity of $10^8$–$10^{14}$ Ωcm.

21. An apparatus according to claim 1, wherein said intermediary transfer member has a volume resistivity of $10^{10}$–$10^{14}$ Ωcm.

22. An apparatus according to claim 20 or 21, wherein said intermediary transfer member includes an electroconductive layer and a surface layer..

23. An apparatus according to claim 1, wherein said voltage applying means includes a voltage source for applying a voltage to said intermediary transfer member.

24. An apparatus according to claim 23, wherein said voltage applying means includes a roller which is contacted to such a side of said intermediary transfer member as is opposite from a side onto which the toner image is transferred, when the toner image is transferred from said image hearing member onto said intermediary transfer member.

25. An apparatus according to claim 24, wherein the voltage is applied onto said intermediary transfer member through said roller.

26. An apparatus according to claim 1, further comprising transferring means movable between a first position in which it urges the transfer material to said intermediary transfer member to transfer the toner images from said intermediary transfer member on the transfer material and a second position in which said transferring means is away from said intermediary transfer member.

27. An apparatus according to claim 26, wherein said transferring means includes a roller.

28. An apparatus according to claim 1 or 2, wherein the first toner is magnetic toner.

29. An apparatus according to claim 28, wherein the magnetic toner is black toner.

30. An image forming apparatus comprising:

an image bearing member;

a movable intermediary transfer member;

voltage applying means for applying a voltage to said intermediary transfer member to sequentially effect overlapping transfer of a plurality of toner images from said image hearing member to said intermediary transfer member at a transfer position, wherein the plurality of toner images are transferred onto a transfer material from said intermediary transfer member; and selecting means for selecting from a first voltage which is substantially the same as the voltage for transferring a first toner image from said image bearing member onto said intermediary transfer member and a second voltage having an absolute value larger than that of the first voltage, when the first toner image on said intermediary transfer member passes through the transfer position in a period which is after the first toner image is transferred from said image bearing member onto said intermediary transfer member and which is before a second toner image next to the first toner image is transferred onto said intermediary transfer member.

31. An apparatus according to claim 30, wherein the absolute value of the second voltage is smaller than that of a third voltage which is applied to said intermediary transfer member by said voltage applying means when the second toner image is transferred from said image bearing member onto said intermediary transfer member.

32. An apparatus according to claim 30, or 31, wherein said selecting means is operative to select either a first mode in which the first toner image on said intermediary transfer member passes through the transfer position during the period or a second mode in which the second toner image is transferred from said image bearing member onto said intermediary transfer member when the first image on said intermediary transfer member passes next time the transfer position.

33. An apparatus according to claim 32, further comprising detecting means for detecting a length of the transfer material in a direction of feeding thereof, wherein said selecting means selects the mode in accordance with an output of said detecting means.

34. An apparatus according to claim 32, wherein said selecting means selects the mode in accordance with a length of a transfer material measured in a direction of feeding thereof.

35. An apparatus according to claim 35, wherein when the length of the transfer material is longer than a predetermined length, said selecting means selects the first mode.

36. An apparatus according to claim 35, further comprising first developing means for forming the first toner image on said image bearing member at a developing position, second developing means for forming the second toner image on said image bearing member at the developing position, and moving means for selectively moving said first developing means and said second developing means to the developing position.

37. An apparatus according to claim 36, wherein a circumferential length L of said intermediary transfer member, a time period t from a completion of formation of the first toner image on said image bearing member by said first developing means at the developing position to completion of movement of said second developing means by said moving means to said developing position, a rotational speed V of said intermediary transfer member, and the length Lp of the transfer material, satisfy:

$$L-Lp<V\times T.$$

38. An apparatus according to claim 35, wherein said selecting means controls the second voltage is accordance with a humidity.

39. An apparatus according to claim 35, further comprising charging means for contacting a surface of said image bearing member to electrically charge the surface of said image bearing member, wherein said selecting means controls the second voltage in accordance with a current through said charging means when a predetermined voltage is applied to said charging means.

40. An apparatus according to claim 35, further comprising charging means for contacting a surface of said image bearing member to electrically charge the surface of said image bearing member, wherein said selecting means controls the second voltage in accordance with a voltage across said charging means when a predetermined current is applied through said charging means.

41. An apparatus according to claim 35, wherein said intermediary transfer member is movable between a first position in which it is contacted to said image bearing member at the transfer position to transfer the toner image from said image bearing member onto said intermediary transfer member and a second position in which said intermediary transfer member is away from said image bearing member.

42. An apparatus according to claim 41, wherein said intermediary transfer member moves to the second position before the first toner image on said intermediary transfer member passes through the transfer position during the period.

43. An apparatus according to claim 34, wherein when a length of the transfer material measured in a direction of feeding thereof is smaller than a predetermined length, said selecting means selects the second mode.

44. An apparatus according to claim 43, further comprising first developing means for forming the first toner image on said image bearing member at a developing position, second developing means for forming the second toner image on said image bearing member at the developing position, and moving means for selectively moving said first developing means and said second developing means to the developing position.

45. An apparatus according to claim 44, wherein a circumferential length L of said intermediary transfer member, a time period t from a completion of formation of the first toner image on said image bearing member by said first developing means at the developing position to completion of movement of said second developing means by said moving means to said developing position, a rotational speed V of said intermediary transfer member, and the length Lp of the transfer material, satisfy:

$$L631\ Lp\geqq V\times t.$$

46. An apparatus according to claim 30, further comprising humidity detecting means for detecting a humidity in said apparatus.

47. An apparatus according to claim 46, wherein said selecting means controls the second voltage in accordance with an output of said humidity detecting means.

48. An apparatus according to claim 30, further comprising charging means for charging residual toner remaining on said intermediary transfer member to a polarity opposite from a regular charge polarity of the toner after the different toner images are transferred from said intermediary transfer member on the transfer material, wherein said transferring means forms an electric field, at the transfer position, effective to transfer the residual toner charged by said charging means from said intermediary transfer member back onto said image bearing member.

49. An apparatus according to claim 48, wherein said voltage applying means forms an electric field, at the transfer position, effective to transfer a next first color toner image from said image bearing member onto said intermediary transfer member and simultaneously to transfer the residual toner charged by the charging means from said intermediary transfer member onto said image bearing member.

50. An apparatus according to claim 30, wherein said intermediary transfer member has a volume resistivity of $10^8$–$10^{14}$ Ωcm.

51. An apparatus according to claim 50, wherein intermediary transfer member has a volume resistivity of $10^8$–$10^{14}$ Ωcm.

52. An apparatus according to claim 50 or 51, wherein said intermediary transfer member includes an electroconductive layer and a surface layer.

53. An apparatus according to claim 30, wherein said voltage applying means includes a voltage source for applying a voltage to said intermediary transfer member.

54. An apparatus according to claim 53, wherein said voltage applying means includes a roller which is contacted to such a side of said intermediary transfer member as is opposite from a side onto which the toner image is transferred, when the toner image is transferred from said image bearing member onto said intermediary transfer member.

55. An apparatus according to claim 54, wherein the voltage is applied onto said intermediary transfer member through said roller.

56. An apparatus according to claim 30, further comprising transferring means movable between a first position in which it urges the transfer material to said intermediary transfer member to transfer the toner images from said intermediary transfer member on the transfer material and a second position in which the transferring means is away from said intermediary transfer member.

57. An apparatus according to claim 56, wherein said transferring means includes a roller.

58. An apparatus according to claim 30 or 31, wherein the first toner is magnetic toner.

59. An apparatus according to claim 58, wherein the magnetic toner is black toner.

* * * * *

UNITED STATES PATENT AND TRADEMARK OFFICE

CERTIFICATE OF CORRECTION

PATENT NO. : 6,330,407 B1
DATED : December 11, 2001
INVENTOR(S) : Shinichi Tsukida et al.

It is certified that error appears in the above-identified patent and that said Letters Patent is hereby corrected as shown below:

Title page,
Item [30], Foreign Application Priority Data "Jun. 19, 1999 (JP) …. 10-172931" should read -- Jun. 19, 1998 (JP) …. 10-172931 --.

Column 7,
Line 6, "polymerisation," should read -- polymerization, --.
Line 10, "mμm." should read -- μm. --.
Line 13, "indicate" should read -- indicates --.

Column 9,
Line 19, "rollers" should read -- roller --.
Line 40, "does not" should read -- does not --.

Column 11,
Line 4, "-1.2 KV." should read -- -1.2 kv. --.
Line 25, "Than," should read -- Then, --.

Column 12,
Line 53, "tuner" should read -- toner --.

Column 13,
Line 51, "transfer" (1st occurrence) should read -- transferred --.
Line 55, "in" should read -- is --.

Column 14,
Line 2, "hearing" should read -- bearing --.
Line 10, "acid" should read -- said --.

Column 15,
Line 35, "L-Lp≥VxT." should read -- L-Lp≥vxt. --.
Line 39, "plurality" should read -- polarity --.
Line 46, "hearing" should read -- bearing --.
Line 53, "means." should read -- member. --.
Line 62, "layer.." should read -- layer. --.

Column 16,
Lines 4 and 26, "hearing" should read -- bearing --.
Line 47, "30, or" should read -- 30 or --.
Line 65, "35," should read -- 34, --.

UNITED STATES PATENT AND TRADEMARK OFFICE

CERTIFICATE OF CORRECTION

PATENT NO. : 6,330,407 B1
DATED : December 11, 2001
INVENTOR(S) : Shinichi Tsukida et al.

It is certified that error appears in the above-identified patent and that said Letters Patent is hereby corrected as shown below:

Column 17,
Line 18, "L-Lp<VxT." should read -- L-Lp<vxt. --.
Line 21, "is" should read -- in --.

Column 18,
Line 5, "L631 LP≥Vxt." should read -- L-Lp≥Vxt. --.
Line 33, "wherein" should read -- wherein said --.

Signed and Sealed this

Twenty-third Day of July, 2002

*Attest:*

*Attesting Officer*

JAMES E. ROGAN
*Director of the United States Patent and Trademark Office*